United States Patent [19]

DeBruyn

[11] Patent Number: 4,627,672

[45] Date of Patent: Dec. 9, 1986

[54] PULL-OUT RACK FOR A CABINET

[75] Inventor: William DeBruyn, Rockford, Ill.

[73] Assignee: Amerock Corporation, Rockford, Ill.

[21] Appl. No.: 713,232

[22] Filed: Mar. 18, 1985

[51] Int. Cl.[4] ..... A47B 88/00

[52] U.S. Cl. ..... 312/331; 211/205; 248/430; 312/271

[58] Field of Search ..... 312/119, 122, 132, 130, 312/271, 331, 330 R, 350, 33 D; 248/429, 430; 211/94, 94.5, 151, 162, 181, 133, 205

[56] References Cited

U.S. PATENT DOCUMENTS

| | | | |
|---|---|---|---|
| 404,790 | 6/1889 | Knaus | 312/331 |
| 427,475 | 5/1890 | Knaus | 312/331 |
| 814,165 | 3/1906 | Rea et al. | 312/331 |
| 2,129,637 | 9/1938 | Atwood et al. | 248/430 X |
| 2,774,644 | 12/1956 | Patterson | 312/331 |
| 3,524,616 | 8/1970 | Marschak | 211/205 X |
| 3,544,187 | 12/1970 | Hils | 312/331 |

OTHER PUBLICATIONS

IBM® Technical Disclosure Bulletin vol. 21, No. 5, Oct. 1978.

*Primary Examiner*—James T. McCall

*Attorney, Agent, or Firm*—Leydig, Voit & Mayer, Ltd.

[57] ABSTRACT

A rack formed by a window-like framework is adapted to support various holders for organizing articles in a cabinet and is adapted to be pulled from a stored position in the cabinet to an accessible position in which substantially the entire rack is disposed completely outside the cabinet. The rack is carried by a bottom-supported mounting assembly having pivoted arms which collapse toward one another as the rack is moved inwardly to its stored position and expand away from one another to form a double-triangular bracing structure as the rack is pulled outwardly to its accessible position. The arms coact with guide rollers on the bottom of the cabinet to hold the rack stable in each of its positions without need of any top support for the rack. One of the holders which is supported by the rack is a wire-grid book shelf equipped with an adjustable bookend which is held by the grids of the shelf.

13 Claims, 12 Drawing Figures

PULL-OUT RACK FOR A CABINET

Background of the Invention

This invention relates generally to a rack for assisting in organizing various articles in a cabinet such as a pantry, a lower kitchen cabinet or other cabinet having a bottom wall and a front opening. The invention relates more particularly to a rack comprising a generally rectangular window-like frame having upright front and rear frame members which carry hangers for supporting various types of article holders such as baskets, shelves and the like.

The present rack is adapted to be moved into and out of the cabinet between stored and accessible positions. When the rack is pulled outwardly to its accessible position, substantially the entire rack is located outside of the cabinet so that easy access can be gained to the articles in the holders.

SUMMARY OF THE INVENTION

The general aim of the present invention is to provide a new and improved pull-out rack of the above general type which may be installed in the cabinet in a quick and easy manner and, even though of substantial height, may be supported in a very stable manner entirely from the bottom of the cabinet and without need of upper suspension tracks or slides.

A more detailed object of the invention is to achieve the foregoing by providing a unique bottom-supported mounting assembly having pivoted arms which collapse toward one another as the rack is moved inwardly to its stored position and expand away from one another to form a double-triangular bracing structure as the rack is pulled outwardly to its accessible position, the arms being arranged in a novel manner and uniquely coacting with guide rollers so as to hold the rack stable in each of its positions.

Still another object is to provide a pivot arm mounting assembly which may be installed in the cabinet in a comparatively easy manner and which may be quickly and simply attached to and detached from the rack to facilitate the installation.

The invention also resides in the ease with which the rack may be installed in different lateral positions in the cabinet.

A further object of the invention is to provide a wire-type book shelf adapted for use with the rack and having a novel bookend which may be adjusted to different fixed positions along the shelf.

These and other objects and advantages of the invention will become more apparent from the following detailed description when taken in conjunction with the accompanying drawings.

DETAILED DESCRIPTION OF THE PREFERRED EMBODIMENT

Figure 1:
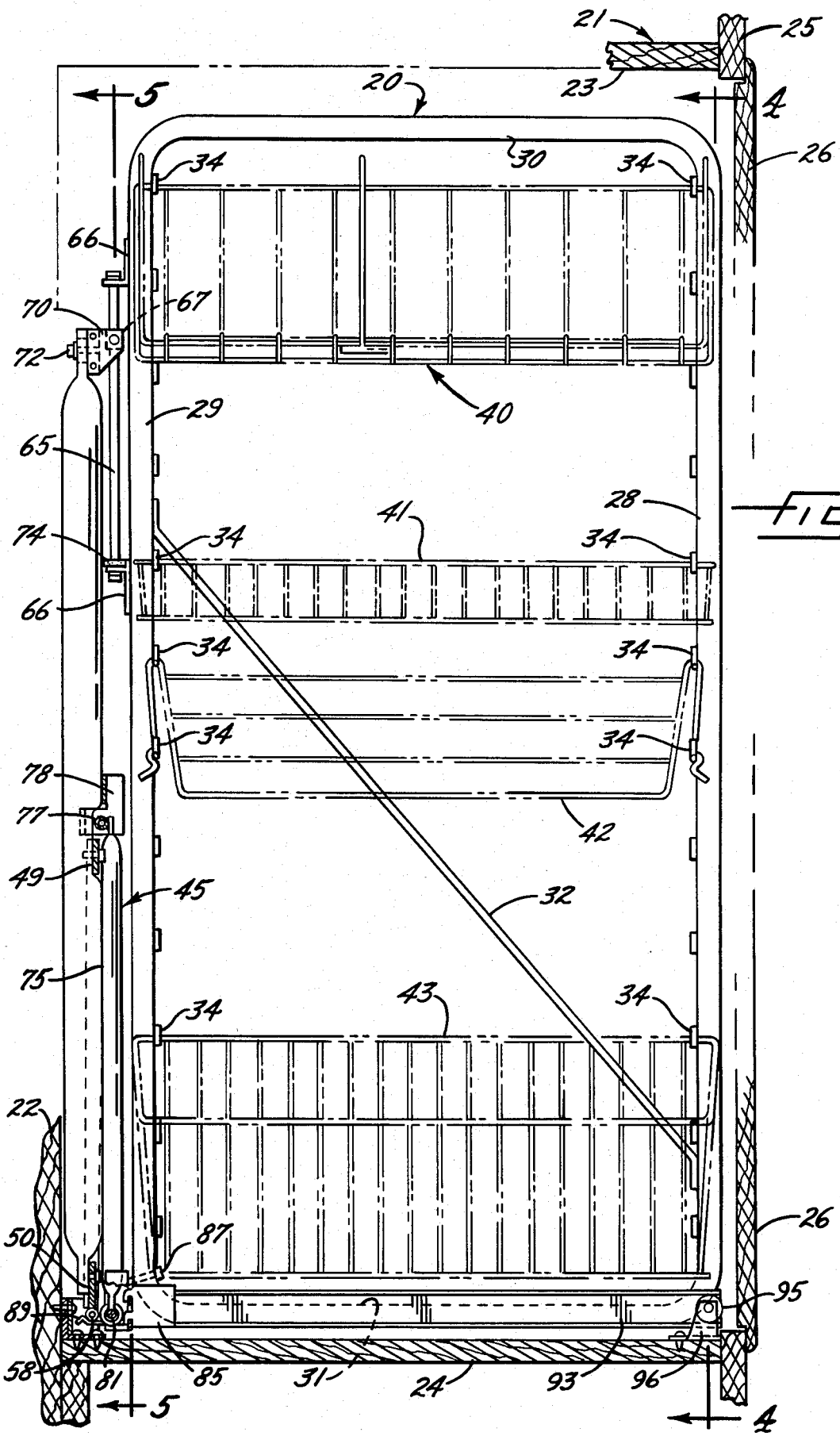
FIG. 1 is a fragmentary cross-sectional view taken vertically through a typical cabinet equipped with a new and improved pull-out rack incorporating the unique features of the present invention, the rack being shown in its stored position with parts of the rack being away and shown in section.

As shown in the drawings for purposes of illustration, the invention is embodied in a rack unit or assembly 20 adapted to be mounted in a cabinet 21 to help organize articles which are placed in the cabinet. While the cabinet may take various forms such as, for example, an under-the-counter cabinet, the particular cabinet which has been illustrated herein is a pantry-type cabinet of substantial height. The cabinet includes a rear wall 22, top and bottom walls 23 and 24 and a front face frame 25 which defines a front opening. The latter normally is closed by a hinged door 26.

The rack 20 is in the form of a rectangular window-like frame of substantial height (e.g., four feet). The rack includes upright front and rear frame members 28 and 29 spaced from one another and spanned by horizontally extending top and bottom frame members 30 and 31. All of the frame members are formed from a single length of tubular steel bent into a rectangle and then joined together at its ends. A brace 32 extends generally diagonally between the front and rear frame members to add rigidity to the rack 20.

Several U-shaped hangers or hooks 34 (FIGS. 3 and 4) are welded to the inboard sides of the front and rear frame members 28 and 29, each hook including a portion projecting laterally beyond each side of the associated frame member. Thus, holders for various articles may span the front and rear frame members and may be hung therefrom by means of the hooks. In the present instance, the holders have been shown as being hung in vertically spaced relation from both sides of the rack 20. For purposes of illustration, the holders on the right side (FIG. 4) of the rack 20 have been shown as including a paper towel holder 35, a spice bottle rack 36, two bin-type baskets 37 and a tray or bag holder 38. The holders on the left side of the rack 20 include a cookbook rack 40, a standard basket 41, a dish towel holder 42 and a deep bin basket 43.

Normally, the rack 20 is located in a stored position completely inside of the cabinet 21 as shown in FIG. 1 to enable full closure of the cabinet door 26. To enable ready access to the holders and the various articles thereof, the rack is adapted to be slid outwardly of the cabinet to an accessible position shown in FIG. 2. When the rack is in its accessible position, substantially the entire rack is located completely outside of the cabinet.

In accordance with the present invention, a novel mounting assembly 45 supports the rack asssembly 20 for in and out sliding, the mounting assembly being particularly characterized in that it supports the rack in a very stable manner off of the bottom wall 24 of the cabinet 21 and avoids the need for guides or slides at the top of the rack. As a result of the mounting assembly 45, the rack may be installed in cabinets of various heights and without need of maintaining a dimensionally controlled relationship between the top of the cabinet and the top of the rack.

Figures 2, 3:
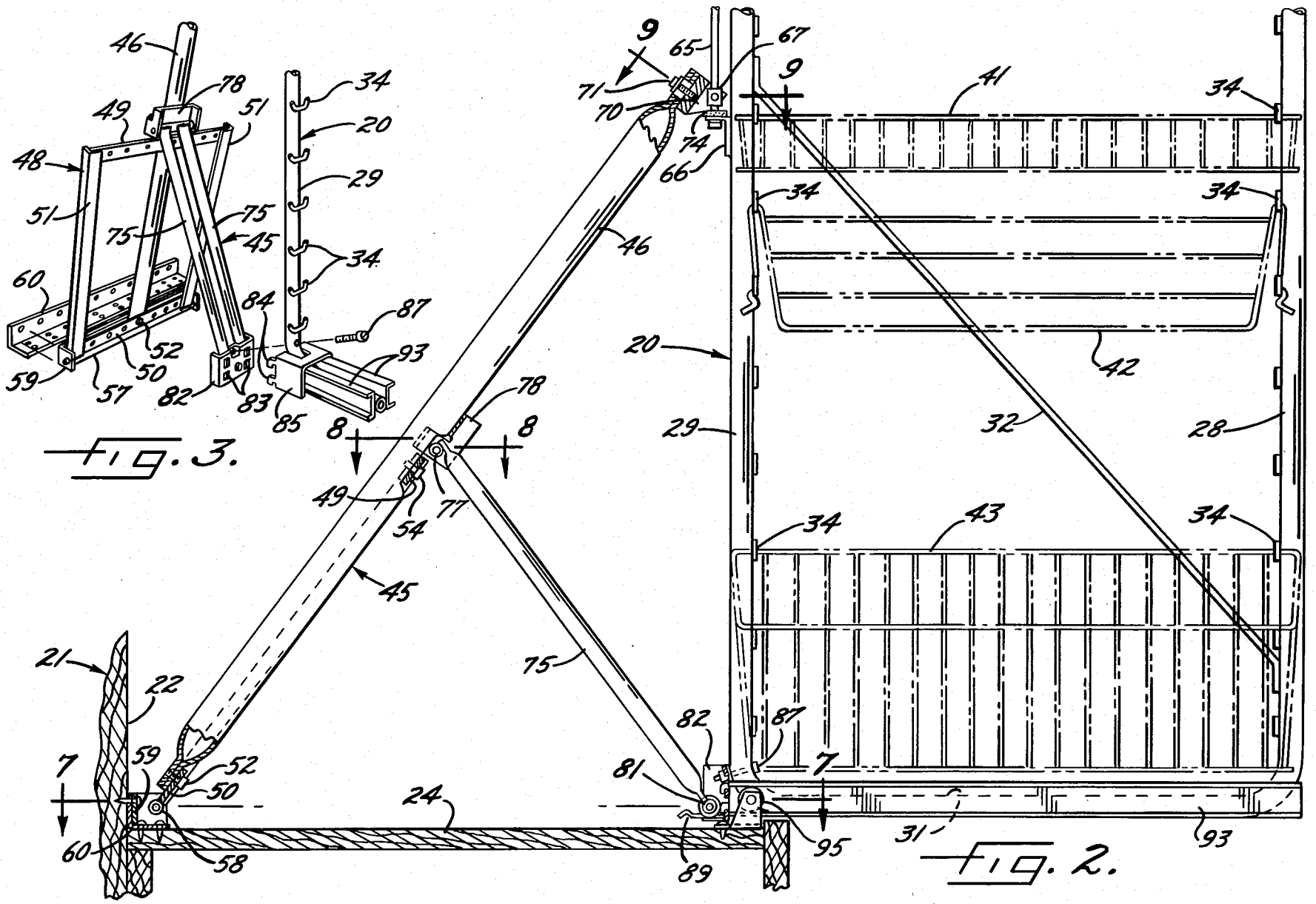
FIG. 2 is a view similar to FIG. 1 but shows the rack pulled out of the cabinet to its accessible position.
FIG. 3 is an perspective view showing parts of the rack and the rack mounting assembly.
Figure 5:
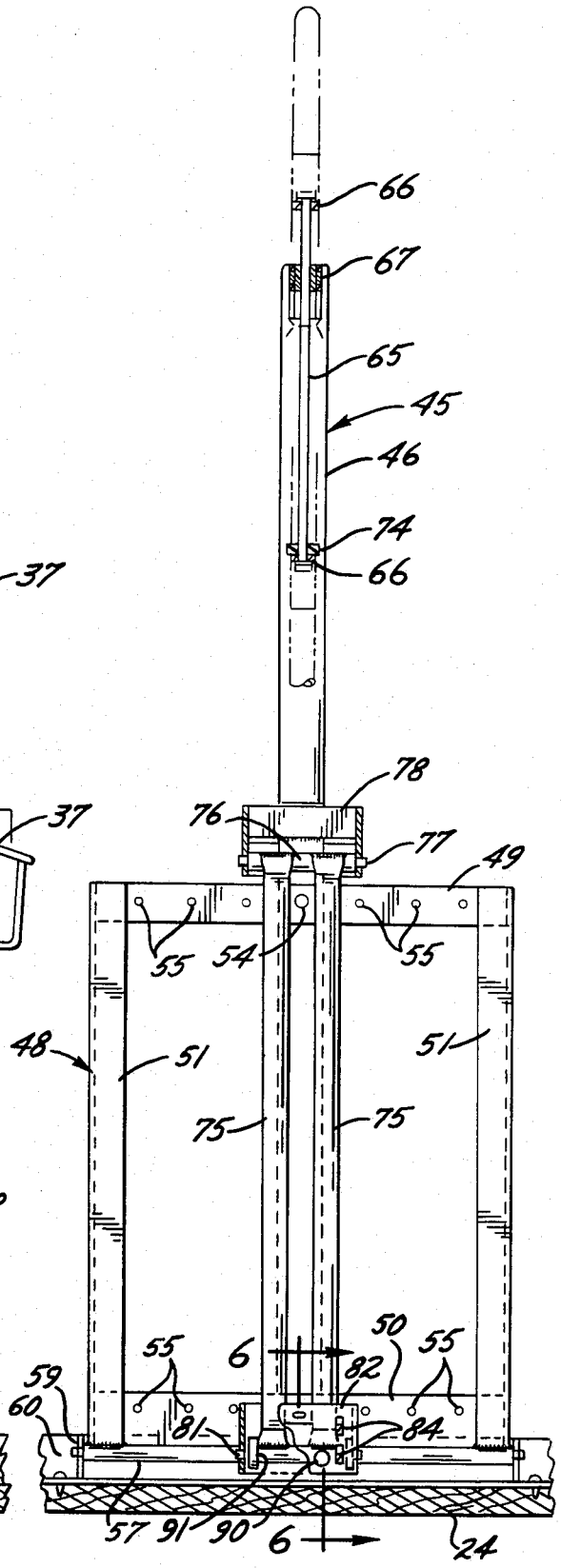

More specifically, the mounting assembly 45 comprises a first pivot arm 46 which extends vertically when the rack 20 is in its stored position (FIG. 1) and extends upwardly and outwardly when the rack is pulled outwardly to its accessible position (FIG. 2). The lower and intermediate portions of the pivot arm 46 are secured to a rectangular window-like framework 48 (FIGS. 3 and 5) having laterally extending top and bottom bars 49 and 50 welded to two side bars 51. A fastener in the form of a screw 52 (FIG. 6) extends through one of a row of holes 53 (FIG. 5) spaced horizontally along the bottom bar 50 and is threaded into the lower end portion of the pivot arm 46 to secure the arm to the bar. Similarly, a screw fastener 54 (FIGS. 2 and 5) extends through a vertically alined hole of a row of horizontally spaced holes 55 in the top bar 49 and is threaded into the arm 46 just short of midway along the length thereof. In the present instance, the screws 52 and 54 are shown as extending through the center holes of the two rows so as to locate the arm 46 in a centered position relative to the framework 48.

Welded to and extending along the lower edge of the bottom bar 50 is an elongated pivot sleeve element 57 (FIGS. 6 and 7) which is supported to turn about a horizontal pivot rod 58. The latter extends between and is fixed to the ends of a generally U-shaped and outwardly facing metal bracket 59. An elongated bracket 60 of L-shaped cross-section is positioned snugly in the corner between the cabinet rear and bottom walls 22 and 24 and is located with its upwardly extending wing sandwiched between the rear wall 22 and the mounting bracket 59. Screws 61 extend horizontally through a row of laterally spaced holes in the mounting bracket 59 and the upwardly extending wing of the mounting bracket 60 and fasten the two brackets securely to the rear wall 22. Additional screws 63 extend through two rows of holes in the horizontally extending wing of the mounting bracket 60 to secure the latter rigidly to the bottom wall 24. While the bracket 59 could be secured directly to the rear wall 22 in well-constructed cabinets, the mounting bracket 60 reinforces the corner joint between the rear and bottom walls and adds stability to the installation.

Figure 9:
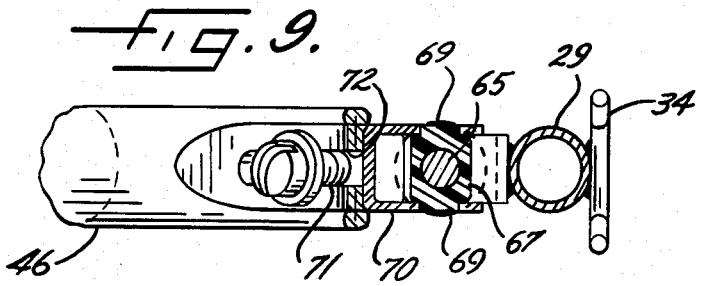

In carrying out the invention, the upper end of the pivot arm 46 is connected to the rack 20 to pivot horizontally relative to the rack and also to slide vertically with respect to the rack so as to support the top of the rack while enabling the rack to be moved inwardly and outwardly. For this purpose, a vertical glide rod 65 (FIGS. 1, 2, 5 and 9) is attached rigidly to the rear side of the rear frame member 29 in rearwardly spaced relation therewith by upper and lower mounting clips 66. A plastic block 67 (FIGS. 2 and 9) with a center hole is supported to slide upwardly and downwardly on the glide rod with relatively friction-free motion, the block being formed with two laterally projecting trunnions 69. The trunnions are rotatably received within holes formed in the laterally spaced wings of a U-shaped mounting bracket 70 having a heavy block-like bight portion. A fastener in the form of a screw 71 extends through an elongated slot 72 in the upper end portion of the pivot arm 46 and is threaded into the bight portion of the mounting bracket 70 to connect the pivot arm to the mounting bracket.

When the rack 20 is in its stored position (FIG. 1), the pivot arm 46 is substantially vertical and is located such that the block 67 and the mounting bracket 70 are disposed near the upper end portion of the glide rod 65. As the rack is pulled outwardly, the arm 46 pivots clockwise about the lower rod 58 and, at the same time, the mounting bracket 70 pivots about the trunnions 69 of the glide block 67 as the block slides downwardly along the rod 65. Outward movement of the rack is stopped when the bracket 70 engages a bumper formed by a resiliently yieldable washer 74 (FIGS. 1, 2 and 5) encircling the glide rod and resting on the lower mounting clip 66. By adjusting the arm 46 relative to the mounting bracket 70 as permitted by the screw 71 and the elongated slot 72, the outwardly stopped position of the rack 20 can be adjusted and, in addition, the rack may be leveled.

Figure 8:
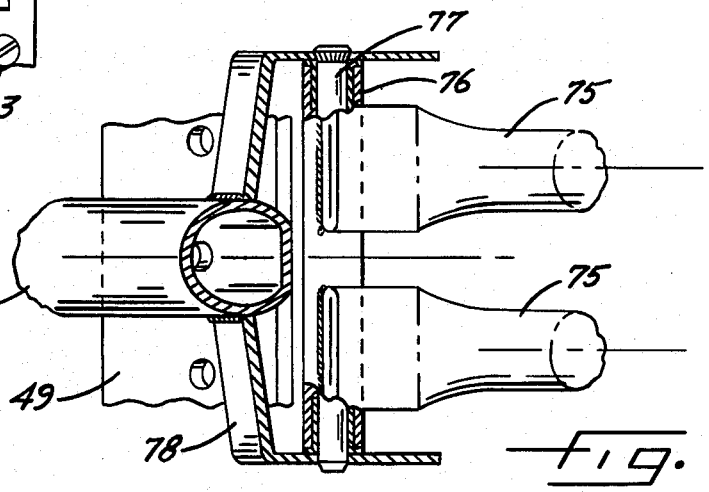
FIGS. 8. and 9 are enlarged fragmentary cross-sections taken substantially along the lines 8—8 and 9—9, respectively of FIG. 2.

The mounting assembly 45 further includes a second pivot arm structure which herein is formed by two laterally spaced arms 75. Welded to and extending laterally between the upper ends of the arms 75 is a sleeve 76 (FIG. 8) which is supported to turn on a laterally extending horizontal pin 77 fastened to a mounting bracket 78. The latter, in turn, is welded to the front side of the pivot arm 46 and is located such that the pivot pin 77 is positioned midway between upper and lower ends of the arm 46.

At their lower ends, the arms 75 are connected by a pivot element or sleeve 80 (FIG. 7) which is rotatably received on a horizontal pivot pin 81. The latter is connected to and extends laterally of a rearwardly facing U-shaped plate 82 which is formed with two horizontally spaced pairs of vertically spaced slots 83. The slots are adapted to receive downwardly extending hooks 84 formed on the rear end of a bracket member 85 of inverted U-shaped cross-section and carried by the rack 20 adjacent the lower rear corner thereof. After the hooks 84 have been inserted into the slots 83 to assemble the bracket member 85 to the plate 82, a connector in the form of a screw 87 (FIG. 6) is inserted through a hole in the lower end portion of the rear frame member 29 and is threaded into a hole in the plate 82 to keep the bracket 85 in interlocking relation with the plate 82.

Figure 6:
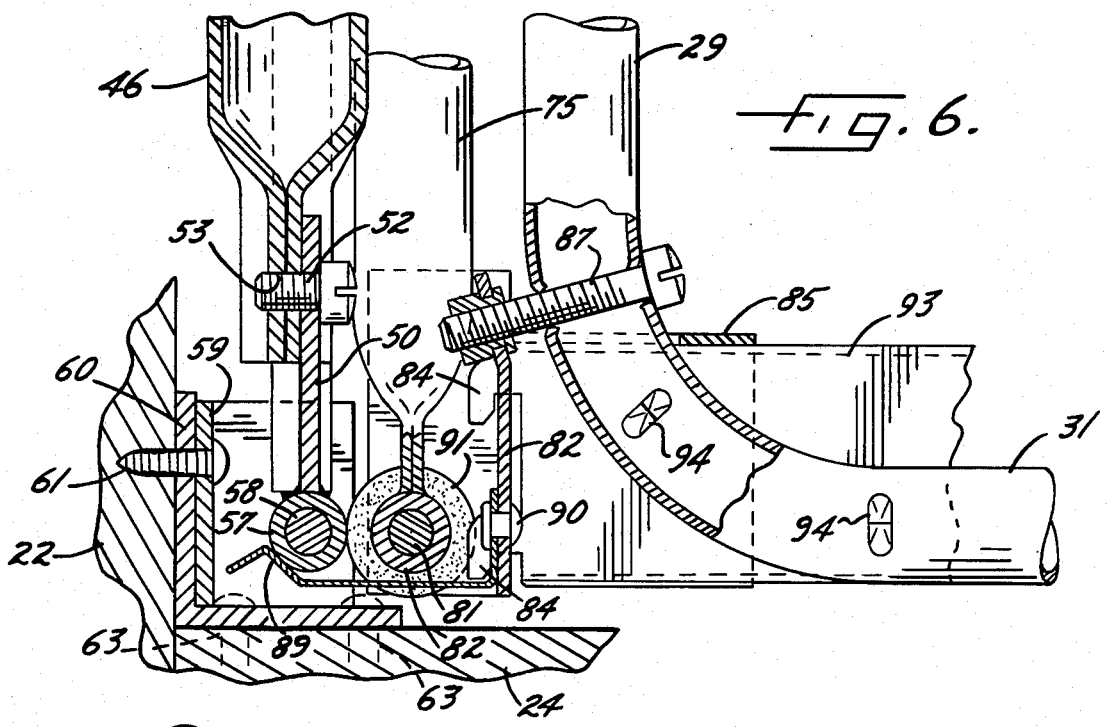
FIG. 6 is an enlarged fragmentary cross-section taken substantially along the line 6—6 of FIG. 5, the rack being shown in its stored position.
Figure 7:
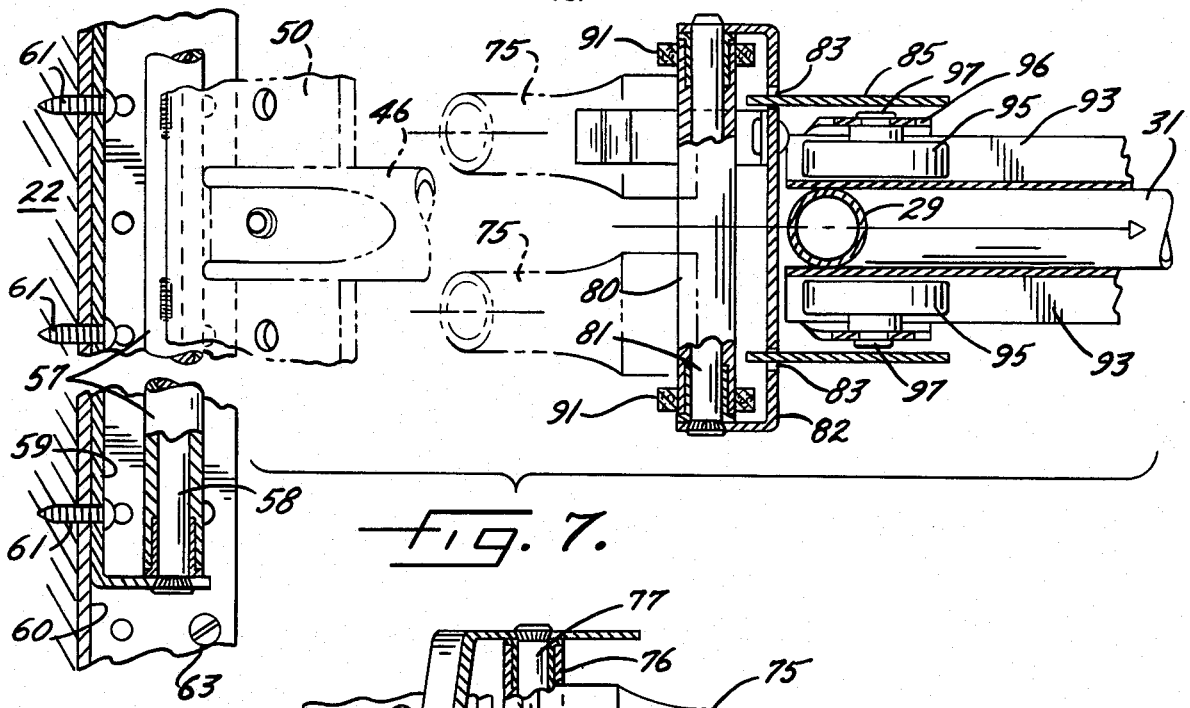
FIG. 7 is an enlarged but foreshortened fragmentary cross-sectional view taken substantially along the line 7—7 of FIG. 2, the rack being shown in its accessible position.

The pivot arms 75 also are upright when the rack 20 is in its stored position and are collapsed so as to lie compactly between the rear frame member 29 and the pivot arm 46 (see FIGS. 1 and 6). When the rack is pulled outwardly, the arms 75 pivot counterclockwise about the pivot pin 82 and expand relative to the arm 46 and rear frame member 29 to the position shown in FIG. 2. In this position, one substantially isosceles triangle is formed by the bottom cabinet wall 24, the lower section of the pivot arm 46 and by the pivot arms 75 while a second isosceles triangle is formed by the pivot arms 75, the upper section of the pivot arm 46 and by the rear frame member 29 of the rack 20. This arrangement, together with lower forward guide means to be described subsequently, holds the rack in a very stable condition when the rack is almost entirely out of the cabinet 21 and without need of any supporting structure between the top of the rack and the upper portion of the cabinet. Accordingly, the vertical dimension between top and bottom of the rack need not be taken into account when installing the rack.

When the rack 20 is returned inwardly to its stored position, a latch in the form of a cantilevered spring finger 89 (FIG. 6) which is riveted at 90 to the rear side of the plate 82 snaps beneath the sleeve 57 to releasably hold the rack in its stored position. In addition, resiliently yieldable bumpers in the form of washers 91 (FIGS. 6 and 7) encircling the end portions of the sleeve 80 engage the sleeve 57 to cushion and quiet the inward movement.

The rack 20 and the mounting assembly 45 are completed by means which guide the rack during its inward and outward movement and which coact with the arms 46 and 75 to keep the rack laterally stable. Herein, these means comprise a pair of channel-shaped guide tracks 93 disposed on opposite sides of the lower frame member 31 and extending along the full length of the lower frame member. The tracks are projection welded as indicated at 94 (FIG. 6) to the lower frame member 31 and are located with their open sides facing laterally outwardly. The bracket 85 is welded to the rear end portions of the tracks 93 and is notched at its upper side to accommodate the rear frame member 29.

Figure 4:
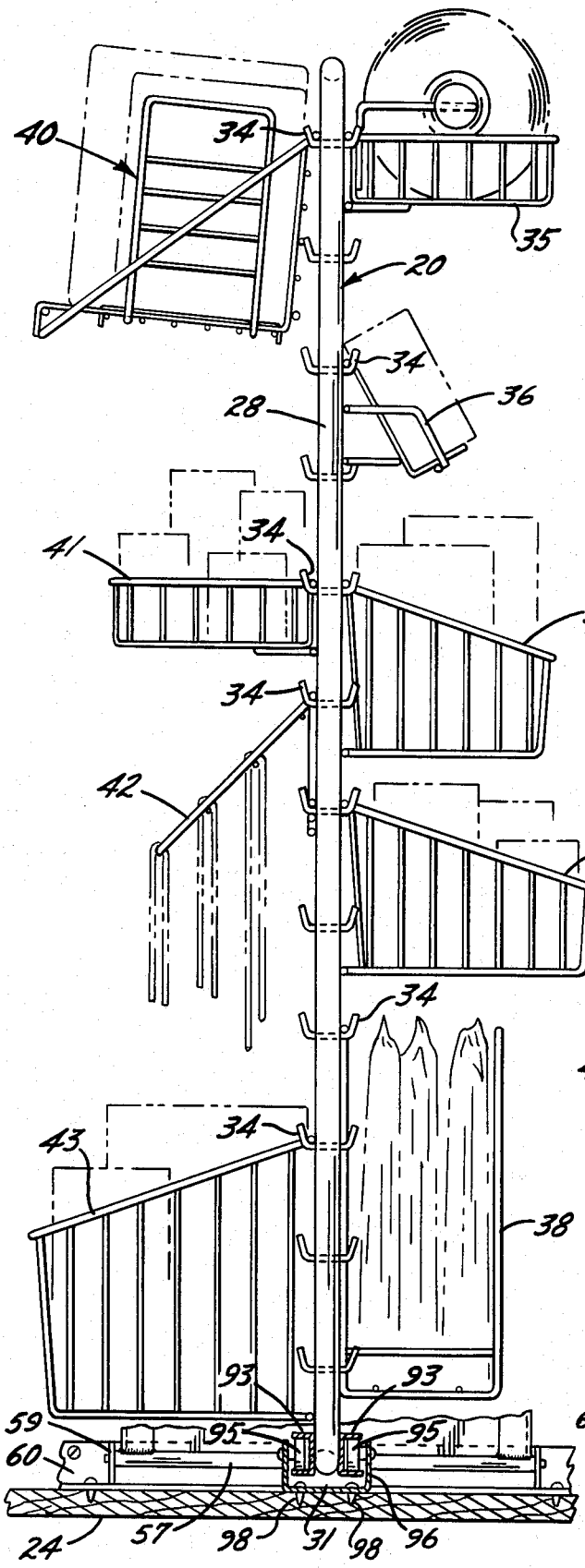
FIGS. 4 and 5 are fragmentary cross-sections taken substantially along the lines 4—4 and 5—5, respectively, of FIG. 1.

Coacting with the tracks 93 to guide and support the rack 20 is a roller assembly comprising two rollers 95 positioned on opposite sides of the lower frame member 31 to fit within the tracks. The rollers are supported to rotate about a horizontal axis by a U-shaped mounting bracket 96 having a bight portion underlying the lower frame member 31 and fastened to the bottom wall 24 of the cabinet 21 by screws 98 (FIG. 4). The wings of the bracket project upwardly along the outboard sides of the tracks 93 and support laterally extending pins 99 (FIG. 7) upon which the rollers 95 rotate. The rollers allow the rack to move inwardly and outwardly with relatively friction-free motion and, being anchored to the bottom wall 24 of the cabinet 21, lend lateral stability to the rack.

When the rack 20 is pulled outwardly, the bracket 70 engages and stops against the resilient bumper 74 and stops outward movement of the rack before the forward side of the plate 82 strikes the rollers 95. In this way, the rollers are protected against repetitive impact and remain solidly attached to the bottom wall 24 of the cabinet 21. The screw 71 may be adjusted in the slot 72 to insure that the bracket 70 stops against the bumper 74 before the plate 82 strikes the rollers.

The rack 20 and the mounting assembly 45 are shipped as separate units as shown generally by FIG. 3. To install the rack, it is necessary only to secure the mounting brackets 59 and 60 to the lower rear corner of the cabinet 21 and to install the roller bracket 96 on the bottom wall 24 of the cabinet. Thereafter, the rack 20 may be connected to the mounting assembly 45 simply by inserting the hooks 84 through the slots 83 and by installing the screws 71 and 87. The ease with which the rack may be connected to the mounting assembly enables the two to be attached temporarily together and set loosely in the cabinet to enable the proper mounting positions for the brackets 59, 60 and 96 to be determined. Thereafter, the rack may be detached from the mounting assembly and removed from the cabinet by releasing the screws 71 and 87. After the brackets have been installed in their proper positions to fix the mounting assembly in the cabinet, the rack may be re-attached to the mounting assembly by the screws 71 and 87. Thus, installation of the rack is a relatively quick and easy task and particularly since the vertical dimension of the rack need not be taken into account.

While the rack 20 has been shown as being located in a centered position in the cabinet 21, it may easily be located in a laterally offset position simply by inserting the screws 52 and 54 in different holes 53 and 55 in the bars 50 and 49 of the framework 48. Thus, the rack may be located closely adjacent either side wall of a cabinet and may carry holders only on one of its sides. As a result, the rack may be installed in a comparatively narrow cabinet and also may be installed in an offset position in a wider cabinet to leave room for other items in the cabinet.

Figure 10:
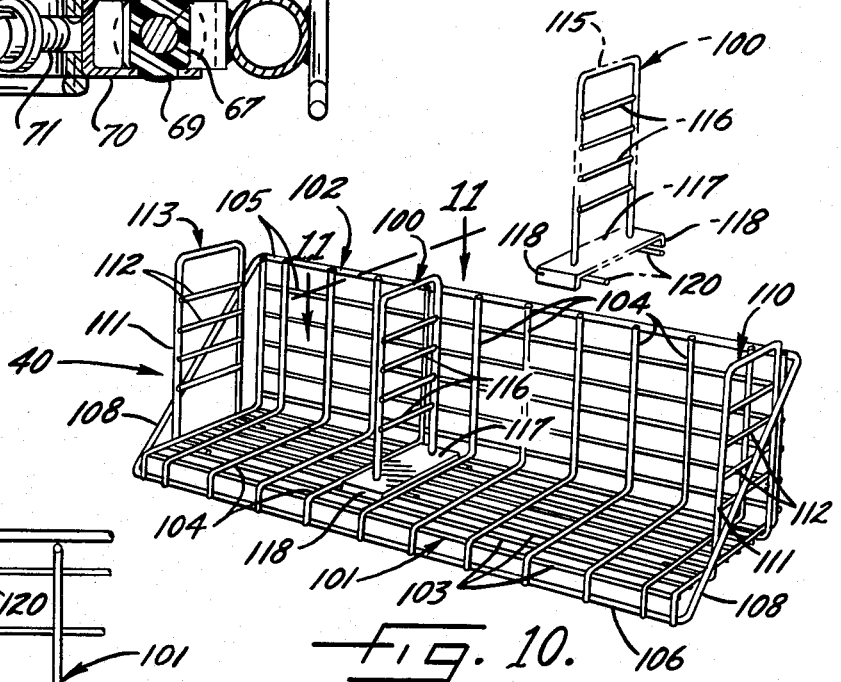
FIG. 10 is a perspective view of the book shelf.

The invention also contemplates the provision of a book rack 40 (FIGS. 1, 4 and 10 to 12) which is made of wire grid and which includes a novel bookend 100 adapted to be adjusted along the rack and held in various fixed positions. Herein, the book rack 40 includes a horizontal shelf 101 and a rear back 102 extending upwardly from the shelf. The shelf includes a series of rectangular grid-like openings formed by horizontally spaced rows of first horizontally extending wires 103 extending lengthwise of the shelf 101 and by horizontally spaced rows of second horizontally spaced wires 104 extending perpendicular to the first wires 103 and located on top the second wires. At their rear ends, the wires 104 are bent upwardly and are connected by vertically spaced rows of horizontal wires 105 to form the back 102 of the rack 40. At their front ends, the wires 104 are bent downardly and are connected by an additional horizontal wire 106 (FIG. 10) to form a depending lip at the front of the shelf 101. The different wires are welded to one another at various locations and thus are connected rigidly together. End wires 108 extend diagonally between the ends of the wire 106 and the ends of the upper wire 105 to form a bracing structure.

A fixed bookend 110 is connected to one end of the shelf 101 and is formed by a wire 111 of inverted U-shaped configuration and connected by horizontally extending cross wires 112. The bookend 110 may be welded rigidly to the rack 40. An identical bookend 113 may be connected to the other end of the shelf.

Figure 11:
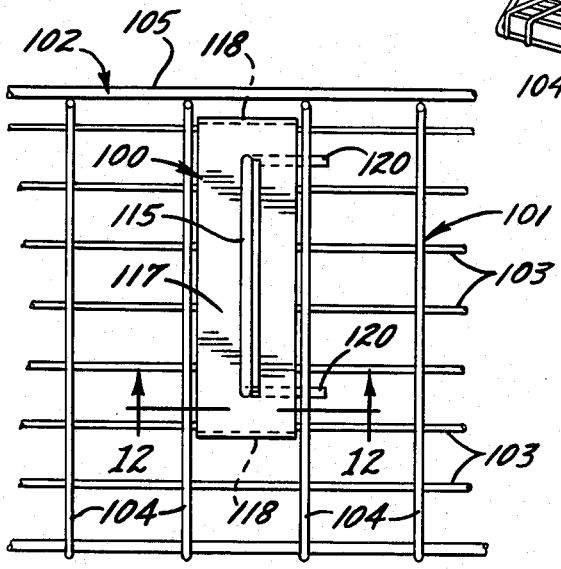
FIG. 11 is a fragmentary top plan view of the book shelf as taken substantially along the line 11—11 of FIG. 10.

The bookend 100 includes an upright book stop generally similar in appearance to the bookends 110 and 113 and formed by an inverted U-shaped wire 115 and by cross wires 116. In carrying out the invention, the bookend 100 also includes a unique base 117 which is attached to the wire 115 and which enables the bookend 100 to be adjusted to various positions along the shelf 101 and held releasably in each adjusted position. As shown in FIG. 11, the base 117 is rectangular and preferably is stamped from sheet metal. The width of the base 117 is slightly less than the width between the transverse wires 104 and thus the base may rest on the wires 103 between two wires 104. The latter wires serve as stops engageable with the sides of the base to restrict the bookend 100 from sliding lengthwise along the shelf 101.

Means also restict the bookend 100 against shifting transversely of the shelf 101. Herein, these means comprise a pair of flanges 118 bent downwardly from the ends of the base 100 and projecting downwardly alongside two of the wires 103. The flanges are engageable with such wires to restrict transverse shifting of the bookend 100.

Figure 12:
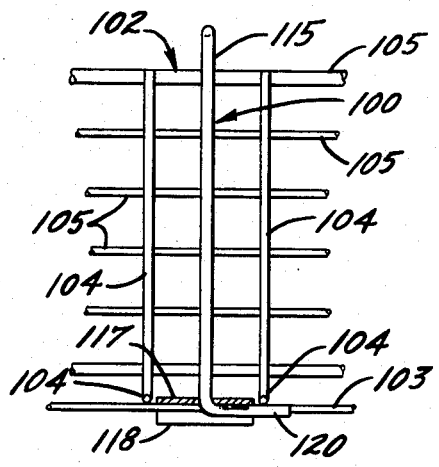
FIG. 12 is a fragmentary cross-section taken substantially along the line 12—12 of FIG. 11.

The bookend 100 is completed by prong means which hold the bookend in a rigid upright position on the shelf 101 but which permit the bookend to be removed from and re-positioned along the shelf. In the present instance, the prong means comprise two transversely spaced wire prongs 120 which project horizontally toward the bookend 110. The prongs underlie one of the wires 104 and preferably are formed by extending the wire 115 downwardly through holes in the base 117 and by bending the lower end portions of the wire 115 at a right angle to define the prongs (see (FIG. 12). The prongs may be welded to the underside of the base.

With the foregoing arrangement, the prongs 120 underlie and hook against one of the wires 104 to prevent the weight of a group of books between the bookends 100 and 110 from causing the bookend 100 from tilting downwardly and away from the bookend 110. By removing one or two books and tilting the bookend 100 downwardly and toward the bookend 110, the bookend 100 may be removed from the shelf 101 and re-positioned therealong to hold a longer or shorter group of books against the bookend 110. By turning the bookend 100 end-for-end, it may be positioned on the shelf 101 to hold books against the bookend 113.

I claim:

1. A pull-out rack for a cabinet having a bottom wall and having a front opening, said rack having interconnected front and rear upright frame members spaced from one another, means on said front and rear frame members for supporting various holders in vertically spaced relation, and means mounting said rack for inward and outward movement between a stored position located completely within the cabinet and an accessible position in which substantially the entire rack is located completely outside the cabinet, said mounting means comprising a first pivot arm having upper and lower end portions, means supporting the lower end portion of said first pivot arm to pivot about a laterally extending horizontal axis located adjacent the rear end of the bottom wall of the cabinet, means connecting the upper end portion of said first pivot arm to said rack intermediate the ends of said rear frame member to slide upwardly and downwardly relative to said rear frame member and to pivot about a laterally extending horizontal axis relative to said rear frame member, said connecting means comprising an upright rod secured to and spaced rearwardly from the rear side of said rear frame member, a block slidable upwardly and downwardly on said rod, and a bracket fixed to the upper end portion of said first pivot arm and pivotally connected to said block, a second pivot arm having upper and lower end portions, means connecting the upper end portion of said second pivot arm to said first pivot arm intermediate the ends thereof to pivot about a laterally extending horizonal axis, means supporting the lower end portion of said second pivot arm to said rack adjacent the lower end portion of said rear frame member to pivot about a laterally extending horizontal axis, said pivot arms being upright and being collapsed adjacent one another with said second pivot arm disposed between said first pivot arm and said rear frame member when said rack is in said stored position, said pivot arms pivoting in opposite directions when said rack is pulled outwardly to said accessible position and expanding during such pivoting to cause a first triangle to be formed by said bottom wall, said second pivot arm and the lower section of said first pivot arm and to cause a second triangle to be formed by said rear frame member, said second pivot arm and the upper section of said first pivot arm, horizontal guide track means extending between said upper and lower frame members adjacent the lower ends thereof, and roller means mounted on the front end portion of the bottom wall of the cabinet to turn about a laterally extending horizontal axis and coacting with said track means to guide said rack for inward and outward movement between said stored and accessible positions.

2. A pull-out rack as defined in claim 1 in which said second pivot arm is connected to said first pivot arm about midway between the ends of said first pivot arm whereby both of said triangles are substantially isosceles triangles.

3. A pull-out rack as defined in claim 1 in which an upright hole is formed through said block and slidably receives said rod, trunnions extending horizontally and laterally from opposite sides of said block, said bracket having spaced wings straddling said block and formed with holes rotatably receiving said trunnions.

4. A pull-out rack as defined in claim 1 in which said rack includes a bottom frame member extending between and connected to said front and rear frame members, said track means comprising a pair of horizontally extending channel-shaped tracks disposed on opposite sides of said bottom frame member and secured rigidly to said bottom frame member, said roller means comprising an upwardly opening U-shaped bracket having a bight portion underlying said lower frame member and said tracks and secured to the bottom wall of the cabinet, said bracket having a pair of wings projecting upwardly from said bight portion and straddling said tracks, and rollers disposed within said tracks and supported by said wings to rotate about a laterally extending horizontal axis.

5. A pull-out rack as defined in claim 1 in which said rack includes a bottom frame member extending between and connected to said front and rear frame members, said track means comprising a pair of horizontally extending channel-shaped tracks disposed on opposite sides of said bottom frame member and secured rigidly to said bottom frame member, said roller means comprising a pair of rollers located on opposite sides of said bottom frame member and located within said tracks, and means on the lower end of said rod and stopping downward sliding of said first pivot arm relative to said rack when said rack is pulled outwardly to said accessible position and before the rear ends of said tracks reach said rollers.

6. A pull-out rack as defined in claim 1 in which said means which support the lower end of said first pivot arm comprise a first laterally extending horizontal pivot element connected to the lower end portion of said first pivot arm, said means which support the lower end portion of said second pivot arm comprising a second laterally extending horizontal pivot element connected to the lower end portion of said second pivot arm, and resiliently yieldable bumper means on one of said pivot elements and engageable with the other pivot element to cushion stopping of said rack when said rack is pushed inwardly to said stored position.

7. A pull-out rack as defined in claim 1 in which said means which support the lower end of said first pivot arm comprise a first laterally extending horizontal pivot element connected to the lower end portion of said first pivot arm, said means which support the lower end portion of said second pivot arm comprising a second laterally extending horizontal pivot element connected to the lower end portion of said second pivot arm, and latch means mounted adjacent one of said pivot elements and releasably engageable with the other pivot element to hold said rack releasably in said stored position.

8. A pull-out rack as defined in claim 7 in which said latch means are mounted adjacent said second pivot element and are carried by said rack.

9. A pull-out rack as defined in claim 7 further including resiliently yieldable bumper means on one of said pivot elements and engageable with the other pivot element to cushion stopping of said rack when said rack is pushed inwardly to said stored position.

10. A pull-out unit for a cabinet having a bottom wall and having a front opening, said unit comprising a rack assembly and further comprising a mounting assembly for mounting said rack assembly for inward and outward movement between a stored position located completely within the cabinet and an accessible position in which substantially the entire rack assembly is located completely outside of the cabinet;

said rack assembly comprising a window-like rack having spaced upright front and rear frame members and further having top and bottom frame members extending between and interconnecting said front and rear frame members, means on said front and rear frame members for supporting various holders in vertically spaced relation, an upright rod secured rigidly to and spaced from the rear side of said rear frame member intermediate the ends thereof, a first mounting bracket supported to slide upwardly and downwardly on said rod and supported to pivot relative to said rod about a laterally extending horizontal axis, and a pair of horizontally extending tracks disposed on opposite sides of said bottom frame member, said tracks being secured rigidly to said bottom frame member and extending along substantially the entire length of said bottom frame member;

said mounting assembly comprising a first pivot arm having upper and lower end portions, a second mounting bracket adapted to be secured rigidly to the bottom wall of the cabinet adjacent the rear end thereof and supporting the lower end portion of the first pivot arm to pivot about a laterally extending horizontal axis, a second pivot arm having upper and lower end portions, means connecting the upper end portion of said second pivot arm to said first pivot arm intermediate the ends thereof to pivot about a laterally extending horizontal axis, a third mounting bracket, means connecting the lower end portion of said second pivot arm to said third mounting bracket to pivot about a laterally extending horizontal axis, and means for releasably connecting said rack assembly to said mounting assembly and for supporting said rack assembly on the bottom wall of the cabinet to roll between said stored and accessible positions, said last-mentioned means comprising a fastener releasably connecting the upper end portion of said first pivot arm to said first mounting bracket to slide and pivot with said first bracket, a connector releasably fastening said third mounting bracket rigidly to said rack adjacent the lower end of said bottom frame member, and a pair of rollers mounted on the front end portion of the bottom wall of the cabinet to turn about a laterally extending horizontal axis, said rollers being disposed on opposite sides of said bottom frame member and being disposed within said tracks to guide said rack for inward and outward movement between said stored and accessible position;

said pivot arms being upright and being collapsed adjacent one another with said second pivot arm disposed between said first pivot arm and said rear frame member when said rack is in said stored position, said pivot arms pivoting in opposite directions when said rack is pulled outwardly to said accessible position and expanding during such pivoting to cause a first triangle to be formed by said bottom wall, said second pivot arm and the lower section of said first pivot arm and to cause a second triangle to be formed by said rear frame member, said second pivot arm and the upper section of said first pivot arm.

11. A pull-out unit as defined in claim 10 in which said rectangular framework having laterally extending top and bottom bars and upright side bars is located adjacent said first pivot arm, the lower bar of said framework being supported to pivot on said second mounting bracket about a laterally extending horizontal axis, each of said top and bottom bars being formed with a laterally extending row of laterally spaced holes, and a pair of fasteners extending through a pair of vertically alined holes in said top and bottom bars and securing said top and bottom bars to said first pivot arm, said fasteners being adapted to extend through a different pair of holes in said top and bottom bars to enable said first pivot arm and said rack to be adjusted laterally relative to said top and bottom bars.

12. A pull-out rack for a cabinet having a bottom wall and having a front opening, said rack having interconnected front and rear upright frame members spaced from one another, means on said front and rear frame members for supporting various holders in vertically spaced relation, and means mounting said rack for inward and outward movement between a stored position located completely within the cabinet and an accessible position in which substantially the entire rack is located completely outside the cabinet, said mounting means comprising a first pivot arm having upper and lower end portions, means supporting the lower end portion of said first pivot arm to pivot about a laterally extending horizontal axis located adjacent the rear end of the bottom wall of the cabinet and comprising a first laterally extending horizontal pivot element connected to the lower end portion of said first pivot arm, means connecting the upper end portion of said first pivot arm to said rack intermediate the ends of said rear frame member to slide upwardly and downwardly relative to said rear frame member and to pivot about a laterally extending horizontal axis relative to said rear frame member, a second pivot arm having upper and lower end portions, means connecting the upper end portion of said second pivot arm to said first pivot arm intermediate the ends thereof to pivot about a laterally extending horizontal axis, means supporting the lower end portion of said second pivot arm to said rack adjacent the lower end portion of said rear frame member to pivot about a laterally extending horizontal axis and comprising a second laterally extending horizontal pivot element connected to the lower end portion of said second pivot arm, resiliently yieldable bumper means on one of said pivot elements and engageable with the other pivot element to cushion stopping of said rack when said rack is pushed inwardly to said stored position, said pivot arms being upright and being collapsed adjacent one another with said second pivot arm disposed between said first pivot arm and said rear frame member when said rack is in said stored position, said pivot arms pivoting in opposite directions when said rack is pulled outwardly to said accessible position and expanding during such pivoting to cause a first triangle to be formed by said bottom wall, said second pivot arm and the lower section of said first pivot arm and to cause a second triangle to be formed by said rear frame member, said second pivot arm and the upper section of said first pivot arm, horizontal guide track means extending between said upper and lower frame members adjacent the lower ends thereof, and roller means mounted on the front end portion of the bottom wall of the cabinet to turn about a laterally extending horizontal axis and coacting with said track means to guide said rack for inward and outward movement between said stored and accessible positions.

13. A pull-out rack for a cabinet having a bottom wall and having a front opening, said rack having interconnected front and rear upright frame members spaced from one another, means on said front and rear frame members for supporting various holders in vertically spaced relation, and means mounting said rack for inward and outward movement between a stored position located completely within the cabinet and an accessible position in which substantially the enitre rack is located completely outside the cabinet, said mounting means comprising a first pivot arm having upper and lower end portions, means supporting the lower end portion of said first pivot arm to pivot about a laterally extending horizontal axis located adjacent the rear end of the bottom wall of the cabinet and comprising a first laterally extending horizontal pivot element connected to the lower end portion of said first pivot arm, means connecting the upper end portion of said first pivot arm to said rack intermediate the ends of said rear frame member to slide upwardly and downwardly relative to said rear frame member and to pivot about a laterally extending horizontal axis relative to said rear frame member, a second pivot arm having upper and lower end portions, means connecting the upper end portion of said second pivot arm to said first pivot arm intermediate the ends thereof to pivot about a laterally extending horizontal axis, means supporting the lower end portion of said second pivot arm to said rack adjacent the lower end portion of said rear frame member to pivot about a laterally extending horizontal axis and comprising a second laterally extending horizontal pivot element connected to the lower end portion of said second pivot arm, latch means mounted adjacent one of said pivot elements and releasably engageable with the other pivot element to hold said rack releasably in said stored position, said pivot arms being upright and being collapsed adjacent one another with said second pivot arm disposed between said first pivot arm and said rear frame member when said rack is in said stored position, said pivot arms pivoting in opposite directions when said rack is pulled outwardly to said accessible position and expanding during such pivoting to cause a first triangle to be formed by said bottom wall, said second pivot arm and the lower section of said first pivot arm and to cause a second triangle to be formed by said rear frame member, said second pivot arm and the upper section of said first pivot arm, horizontal guide track means extending between said upper and lower frame members adjacent the lower ends thereof, and roller means mounted on the front end portion of the bottom wall of the cabinet to turn about a laterally extending horizontal axis and coacting with said track means to guide said rack for inward and outward movement between said stored and accessible positions.

* * * * *